United States Patent [19]

Molins

[11] 4,193,558

[45] Mar. 18, 1980

[54] CONTINUOUS WEB SUPPLY APPARATUS

[75] Inventor: Desmond W. Molins, London, England

[73] Assignee: Molins Limited, London, England

[21] Appl. No.: 941,339

[22] Filed: Sep. 11, 1978

[30] Foreign Application Priority Data

Sep. 23, 1977 [GB] United Kingdom ..... 39637/77

[51] Int. Cl.[2] ..... B65H 19/16; B31F 5/00

[52] U.S. Cl. ..... 242/58.4; 156/502

[58] Field of Search ..... 242/58.4, 58.1, 58.2, 242/58.3, 58.5; 156/502, 507

[56] References Cited

U.S. PATENT DOCUMENTS

| | | | |
|---|---|---|---|
| 1,261,056 | 4/1918 | Pfohl | 242/58.4 X |
| 2,435,376 | 2/1948 | Wilcoxon | 242/58.4 X |
| 2,998,204 | 8/1961 | Walsh | 242/58.1 |
| 3,627,616 | 12/1971 | Davis | 156/507 |

*Primary Examiner*—Edward J. McCarthy
*Attorney, Agent, or Firm*—John C. Smith, Jr.

[57] ABSTRACT

Apparatus for delivering continuous web, for example paper web for use in a continuous-rod cigarette-making machine, comprises means for rotating a reel of web and a rotary feed device, such as a suction roller, which operates at a speed higher than that at which web is delivered and exerts a nonpositive grip on the web to drive the web past a splicing unit into a buffer reservoir; thus, when the reel rotating means stops, the rotary feed device slips relative to the stationary web.

11 Claims, 5 Drawing Figures

CONTINUOUS WEB SUPPLY APPARATUS

This invention relates to apparatus for supply of continuous web to a machine, particularly although not necessarily exclusively to the supply of paper web to a continuous-rod cigarette-making machine.

In the supply of continuous web, e.g. paper web, to a machine which utilises the web in its operation, it is a not uncommon requirement that the web feed shall be continuously maintained. However, as the web is normally provided in finite lengths - usually in the form of reels - provision has to be made for joining the trailing end of each length of web to the leading end of the next length. An example of this is found in cigarette-making where continuous-rod cigarette-making machines are normally provided with accommodation for two reels of paper and a splicer which automatically joins the web from one reel to the leading end of the web from the second reel as the one reel becomes (or is about to become) exhausted. Then an operator can load a fresh reel in place of the exhausted reel, in preparation for the next automatic splice when the web from the fresh reel has to be joined to the web from the second reel.

When the splicer operates, it is usually necessary for the web to be stationary. Hence between the splicer and the web-consuming machine a reservoir is provided, holding a sufficient length of web to allow continuous running of the machine while a splice is being made. The reservoir is refilled after each splicing operation by feeding web to it at a speed somewhat higher than the speed at which the machine uses web, the quantity of web in the reservoir being sensed and feed temporarily stopped whenever the reservoir is nearly full and restarted before the length of web in the reservoir is insufficient to permit continuous machine operation while a splice is made.

The paper feed is therefore stopped and restarted quite frequently, and it is an object of the present invention to provide a feed apparatus which permits this to happen without imposing abrupt changes in web tension which could increase the frequency of web breakage.

According to the invention there is provided apparatus for supplying continuous web to a consuming machine, in which means is provided for rotating a reel of web to deliver web therefrom, and a rotary feed device is arranged to receive and drive the web thus delivered from the reel past a splicing unit into a buffer reservoir, in which the feed device is arranged to operate continuously at a speed higher than that at which web is delivered from the reel and to exert a non-positive grip on the web so that, whenever the reel rotating means is stopped, the rotary feed device slips relative to the stationary web.

Preferably the rotary feed device is a suction roller. The reel rotating means is normally arranged to deliver web at a speed somewhat (e.g. 5%) higher than the speed at which web is used by the consuming machine and the rotary feed device then operates at a yet higher speed e.g. 10% faster than the speed of web used by the machine.

A roller may be arranged to be resiliently pressed against web feeding from the reel so as to be displaced upon exhaustion of the reel and connected to the splicing unit so that such displacement initiates operation of the splicing unit.

Nomrally apparatus embodying the invention includes means for mounting two reels with one slightly inclined to the other so that webs fed from the respective reels travel along convergent paths to the splicing unit. Separate means are conveniently provided for rotating the two reels, and each such means may comprise a drive belt engageable with the periphery of the reel to be rotated; drive to the belts may be controlled by a detector sensing the quantity of web in the reservoir.

In order that the invention may be well understood, a preferred embodiment thereof will now be described, with reference to the accompanying diagrammatic drawings, in which.

Figure 1:
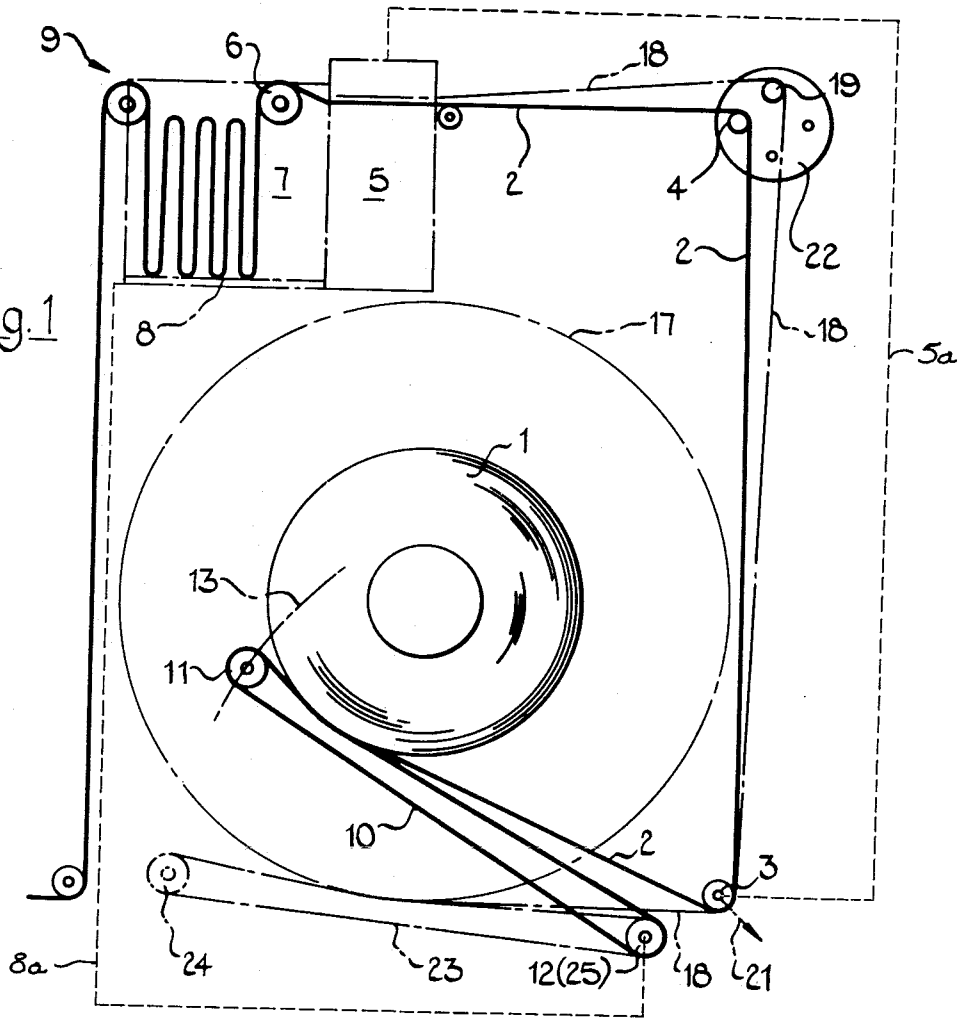
FIG. 1 is a side view of an apparatus embodying the invention.

A reel 1 supplies paper web 2 (shown in solid line) from its lowest point along a horizontal path to a guide/detector roller 3, thence along a vertical path to a guide roller 4, and horizontally to an automatic splicer unit 5, a drive capstan 6, and down into a web reservoir 7 having a weigher-type detector 8 as its bottom. From the reservoir the web feeds out at discharge opening 9 towards a consuming machine such as a continuous-rod cigarette-making machine (not shown).

A drive belt 10 carried by pulleys 11,12 engages the periphery of the reel 1, the pulley 11 being mounted and resiliently biased for movement along an arc (centred on the axis of pulley 12) indicated by dashed line 13 as the size of the reel 1 decreases during use.

Figure 2:
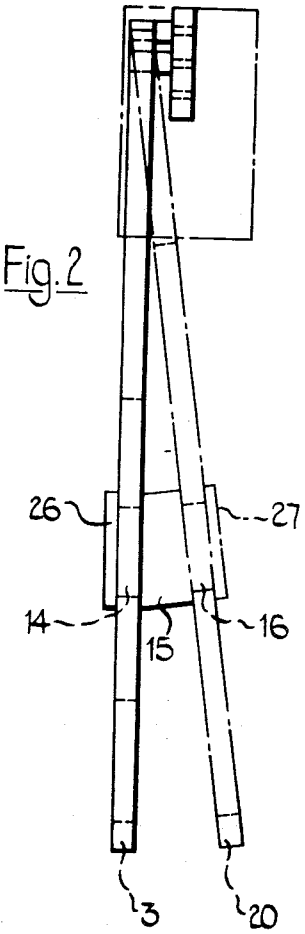
FIG. 2 is an end view of the apparatus of FIG. 1.

The reel 1 is carried on a stub shaft 14 projecting from one face of a fixed support 15 (FIG. 2), and a second stub shaft 16 projects from an opposite face of the support 15 and carries a second reel 17. The shaft 14 is horizontal and the shaft 16 is inclined upwardly by a small angle above the horizontal. Paper web 18 is threaded from the reel 17 along a path similar to, but converging with, the path of the web 2, and completely overlaps (at a slight spacing) the web 2 as the latter reaches the guide roller 4; here the web 18 is passed around a corresponding guide roller 19 and its leading end is anchored in the splicer unit 5 in readiness for a splicing operation.

The web 18 passes around a guide/detector roller 20 which corresponds to the roller 3; each of these rollers 3,20 is resiliently biased in a direction indicated by the arrow 21 and is connected (as indicated by broken line **5*a* in FIG. 1) to the splicer unit 5 so as to initiate a splicing operation when tension in the corresponding web 2, 18 falls to zero, (normally due to the web becoming exhausted but on occasion due to a break in the web). The two rollers 3, 20 are mounted in slightly different attitudes, roller 3 having its axis horizontal while roller 20 has its axis inclined at an angle corresponding to the inclination of the stub shaft 16**.

Similarly, the two rollers 4, 19 are mounted in different attitudes, the axis of roller 4 being horizontal and that of roller 19 being inclined. Both the rollers 4, 19 are detachably carried on a rotatable mounting disc 22 which has four positions at which said rollers can be attached to it. When the web on one of the reels, say reel 1, is exhausted, the relaxation of tension in the web 2 permits roller 3 to move, initiating operation of the splicer unit 5, so that the leading end of web 18 is secured to the web 1 and the feed of the web to the consuming machine continues from the reel 17. To prepare for the time when the web on reel 17 is exhausted, an operator fits a fresh full reel on to the stub shaft 14 and threads new web therefrom around roller 3 towards the splicer unit 5. New web from the fresh reel must however approach the splicer unit 5 above the web 18 from reel 17, so the operator detaches roller 4 from disc 22, rotates the latter 90° anticlockwise (thus bringing the path of the web 18 between this region and the splicer unit 5 to the level at which web 2 is shown in FIG. 1), attaches the roller 4 to the disc 22 at the next mounting point clockwise from the roller 19 (i.e. at about the "12 o'clock" position on the disc 22) and threads the new web around the roller 4, and to the splicer unit 5 at the level at which web 18 is shown in FIG. 1.

Figure 3:
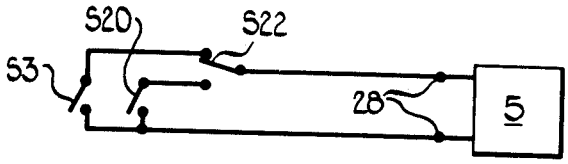
FIG. 3 is an electric circuit diagram.

When one reel becomes exhausted and the splicer unit 5 operates, it is necessary to changeover the control of the splicer unit 5 from the roller 3 to the roller 20 or vice versa. Normally this control is effected electrically, a sufficient displacement of the roller 3 or 20 operating a respective switch S3 or S20 (FIG. 3) to complete a splice initiation circuit in the splicer unit 5 by bridging external terminals 28 and thus a change of control between roller 3, 20 necessitates operation of a changeover switch S22 which determines whether the switch S3 of roller 3 or the switch S20 of roller 20 is connected across said terminals. Conveniently such changeover switch S22 may be connected to the disc 22 and operated by rotation of that disc, as described above, in the course of fitting a fresh reel to the apparatus as above described.

A further drive belt 23, carried by pulleys 24, 25, (and similar to the belt 10 and pulleys 11, 12) is provided to engage and drive the periphery of reel 17. The drives to the belts are provided, preferably, from the consuming machine to pulleys 12, 25 via individual clutches (not shown) and whenever the splicer unit 5 is operated, the clutch associated with the reel from which web has previously been fed is disengaged as splicing is initiated and the other clutch is engaged as splicing is completed. The web is fed during normal running at a speed slightly in excess of (e.g. 5% greater than) the speed at which web is used by the consuming machine, the detector 8 in reservoir 7 serving to control (as indicated by broken line **8*a* in FIG. 1) the feed of the web in known manner so that the reservoir 6** is not overfilled and the mean speed of web feed is thus matched to that of the consuming machine.

The capstan 6 is a suction roller and is driven at a peripheral speed greater than the speed of the belt 10 or 23, thus ensuring a suitable tension in the web between the reel and the capstan, such a suction device being able to slip relative to the web it is feeding without damage to the latter, and enabling the web to be stopped rapidly when a splicing operation is performed, and accelerated rapidly thereafter, without undue risk of web breakage.

It is noted that the stub shafts 14, 16 are provided with annular retainers 26, 27 respectively; these retainers preferably have sprung detents (not shown) to engage grooves or recesses in their respective stub shafts so that they prevent the respective reels 1, 17 from moving off the shafts 14, 16 but can be easily removed and replaced by the operator when required.

Various changes or modifications are possible in the details of the apparatus described without departing from the scope of the invention. Thus for example both stub shafts 14, 16 may be upwardly inclined so that the arrangement of the two reels is symmetrical.

Figure 4:
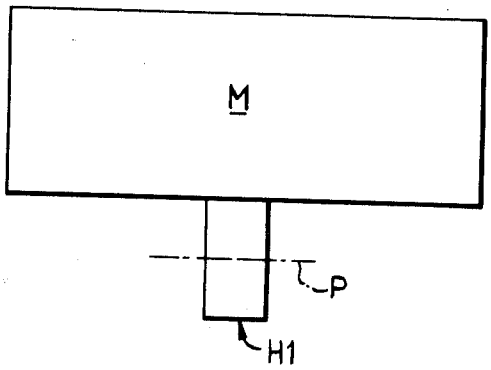
FIGS. 4 and 5 are plan views illustrating how apparatus embodying the invention may be disposed relative to an associated machine.

It will be appreciated that an apparatus as above described must be so placed, in relation to any associated consuming machine, that access to the apparatus is possible from both sides to enable a fresh reel to be fitted on either stub shaft while web is being drawn from a reel on the other stub shaft. Thus when used with, for example, a continuous-rod cigarette-making machine the apparatus may as indicated in FIG. 4 be placed in a suitable housing H 1 projecting at right-angles to the length of the cigarette-making machine M, i.e. so that a vertical plane P in which the axes of the reels carried by the stub shafts lie is parallel to the "rod-line" of the machine (i.e. the axis of cigarette rod being formed in the machine). Paper web delivered at discharge opening 9 then needs to be turned through 90° within the cigarette-making machine but this presents no problems; convenienty for example the web may be fed downwardly and around a guide roller below the rod line, then given a 90° twist as it passes upwardly to enter the garniture of the machine.

Figure 5:
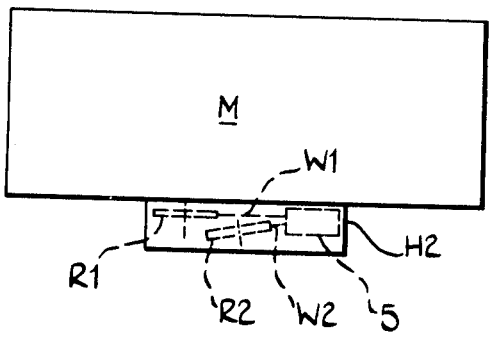

An alternative arrangement is illustrated in FIG. 5; here a housing H 2 is disposed with its major dimension parallel to the length of the associated machine M. Within the housing H 2 are two reels R1, R2; reel R1 has its axis horizontal and at right-angles to the length of the machine, reel R2 has its axis at a slight inclination (as seen in plan) so that paths W1, W2 of web from the respective reels coverage towards splicing unit 5. For compactness, the positions of the two reels are such that they overlap slightly; the overlap clearly must not be great or loading of fresh reels is impeded.

With either arrangement, the splicing unit 5 can readily be arranged to be at about the waist height of an operator, which is probably the optimum level for convenient and speedy threading of web when a fresh reel is loaded.

I claim:

1. Apparatus for supplying continuous web to a consuming machine, comprising means for rotating a reel of web to deliver web therefrom, a splicing unit, a buffer reservoir, and a rotary feed device arranged to receive web delivered from the reel and drive the web past the splicing unit into the reservoir, wherein the rotary feed device is arranged to operate at a speed higher than that at which web is delivered from the reel and to exert a non-positive grip on the web so that, whenever the web is stopped, the rotary feed device slips relative to the stationary web.

2. Apparatus as claimed in claim 1, in which the rotary feed device is a suction roller.

3. Apparatus as claimed in any one of claims 1 and 2, including a roller arranged to be resiliently pressed against web feeding from the reel so as to be displaced upon exhaustion of the reel and connected to the splicing unit so that such displacement initiates operation of the splicing unit.

4. Apparatus as claimed in claim 3, including means for mounting two reels with one slightly inclined to the other so that webs fed from the respective reels travel along convergent paths to the splicing unit.

5. Apparatus as claimed in claim 4, including separate means for rotating the two reels, each such means comprising a drive belt engageable with the periphery of the reel to be rotated.

6. Apparatus as claimed in claim 5, including a detector for sensing the quantity of web in the reservoir, said detector being arranged to control the drive to said drive belts.

7. Apparatus as claimed in any one of claims 1 and 2, including means for mounting two reels with one slightly inclined to the other so that webs fed from the respective reels travel along convergent paths to the splicing unit.

8. Apparatus for supplying continuous web along a path to a consuming machine, comprising (a) means for rotating a reel of web to deliver web therefrom along said path;

(b) a splicing unit along said path downstream of said reel rotating means;

(c) a buffer reservoir along said path downstream of said splicing unit; and (d) a feed device along said path between said splicing unit and said buffer reservoir arranged to receive web delivered from said reel and drive said web past said splicing unit and into said buffer reservoir, said feed device being adapted to operate at a speed higher than that at which web is delivered by said reel rotating means from said reel but adapted to maintain only a predetermined limited tension in said web between said reel and said rotary feed device;

(e) whereby said web may be stopped rapidly for a splicing operation by said splicing unit and accelerated rapidly thereafter without risk of said web breaking.

9. Apparatus as claimed in claim 8 wherein said feed device comprises means to exert a non-positive grip on said web such that said feed device slips relative to said web when said predetermined limited tension in said web is exceeded.

10. Apparatus as claimed in claim 9 wherein said feed device is a rotary feed device.

11. Apparatus as claimed in claim 10 wherein said rotary feed device is a suction roller, the periphery of which is adapted to engage said web.

* * * * *